US011125058B2

(12) United States Patent
Watson

(10) Patent No.: US 11,125,058 B2
(45) Date of Patent: Sep. 21, 2021

(54) METHOD OF WELLBORE OPERATIONS

(71) Applicant: Silverwell Technology Ltd., Histon (GB)

(72) Inventor: Peter John Watson, Foxton (GB)

(73) Assignee: SILVERWELL TECHNOLOGY LTD, Histon (GB)

( * ) Notice: Subject to any disclaimer, the term of this patent is extended or adjusted under 35 U.S.C. 154(b) by 0 days.

(21) Appl. No.: 16/570,737

(22) Filed: Sep. 13, 2019

(65) Prior Publication Data

US 2021/0079770 A1 Mar. 18, 2021

(51) Int. Cl.

| | |
|---|---|
| ***E21B 43/12*** | (2006.01) |
| ***E21B 47/11*** | (2012.01) |
| ***E21B 47/06*** | (2012.01) |

(52) U.S. Cl.

CPC ..... *E21B 43/122* (2013.01); *E21B 47/06* (2013.01); *E21B 47/11* (2020.05)

(58) Field of Classification Search

CPC ..... E21B 43/122; E21B 47/06
USPC ..... 166/250.12
See application file for complete search history.

(56) References Cited

U.S. PATENT DOCUMENTS 6,101,447 A 8/2000 Poe, Jr.
8,596,354 B2 * 12/2013 Hartshorne ..... E21B 47/11 166/252.6
2002/0079098 A1 * 6/2002 Clark ..... E21B 43/11857 166/250.12
2003/0056952 A1 * 3/2003 Stegemeier ..... E21B 47/11 166/250.12
2009/0293634 A1 12/2009 Ong
2011/0040485 A1 2/2011 Ong
2017/0183955 A1 6/2017 Peacock et al.

OTHER PUBLICATIONS

UKIPO Combined Search and Examination Report issued in the prosecution of patent application No. 2013772.5, dated Apr. 29, 2021, 11 pages.

* cited by examiner

*Primary Examiner* — Zakiya W Bates
*Assistant Examiner* — Ashish K Varma
(74) *Attorney, Agent, or Firm* — Bracewell LLP; Constance Ghall Rhebergen

(57) ABSTRACT

A method of estimating a real time production flowrate from a well by estimating a real time flowrate of a marker fluid in the well, and comparing the estimated flowrate with a baseline marker fluid flowrate; where the baseline marker fluid flowrate correlates to baseline production fluid flowrate. The baseline marker fluid flowrate is obtained by introducing an amount of a marker fluid in the well, monitoring the time over which the marker fluid travels a set distance, and estimating a flowrate of the marker fluid based on the monitored time and amount of marker fluid. The real time production flowrate is obtained by extrapolating the baseline production fluid flowrate by an amount derived from a comparison of the baseline and real time marker fluid flow rates.

19 Claims, 3 Drawing Sheets

METHOD OF WELLBORE OPERATIONS

BACKGROUND OF THE INVENTION

1. Field of Invention

The present disclosure relates to operating a well based on an estimate of flow from the well. More specifically, the present disclosure relates to estimating flow by monitoring a flowrate of a marker fluid from the well, and comparing the monitored flowrate with a datum monitored flowrate of the marker fluid in the well.

2. Description of Prior Art

Well systems, such as those for producing fluid from hydrocarbon bearing formations, are generally evaluated throughout the life of the well, and by a number of different tests. Some types of tests are used to estimate an amount of fluid being produced, and identify constituents making up the produced fluid. The test results are sometimes used to evaluate performance of a particular well, and in other instances to assess an entire reservoir. Typically, reservoir analysis involves testing of all or most wells producing from a reservoir under investigation. A forecast of reservoir or well production is typically based on well test results; and sometimes the test results indicate problems with a particular well and that could require a well intervention.

Fluid produced from a well often includes a multi-phase mixture of liquid hydrocarbon, water, and gas; and which is generally difficult to obtain real time in-line flowrate measurements. The percentages of the parts making up the produced fluid can vary over the life of the well; which also complicates flowrate measurements. One well test for estimating flow of a well involves directing the entire flow from a well to a vessel over a set period of time. Inside the vessel the components of the produced fluid are separated from one another, and separately flowed from the vessel. The respective amounts of each of the components are measured as they are exiting the vessel. Some of the drawbacks of this approach are that it requires the presence and attention of field personnel putting them at risk, and using their time that could otherwise be addressing other issues. There is a time lag to obtain results from well tests covering a field or reservoir which takes considerable amounts of scheduling and management. These tests therefore are usually infrequently performed due to their time intensive nature; accordingly, because flowrates of produced fluid change over the life of the well, well performance data is often outdated.

SUMMARY OF THE INVENTION

Disclosed herein is an example method of operating a well that involves obtaining data from a well test, where the data includes a flow velocity of production fluid flowing in tubing disposed in the well. A lift fluid is added to the tubing, pressure in the tubing is monitored over time and at spaced apart locations, and a detectable marker fluid is introduced into the tubing at a time when conditions in the well are substantially similar to conditions in the well during the well test. The presence of the marker fluid is detected at the spaced apart locations based on the step of monitoring pressure in the tubing, and a reference flow velocity of the production fluid is estimated based on a distance between the spaced apart locations and a time span between when the presence of the marker fluid is detected at the spaced apart locations. An amount of marker fluid is introduced into the tubing having a density different from a density of the mixture and at a point in time after the well test was performed, the presence of the marker fluid is detected at the spaced apart locations based on the step of monitoring pressure in the tubing, and a real time flow velocity of the production fluid is estimated based on a distance between the spaced apart locations and a time span between when the presence of the marker fluid is detected at the spaced apart locations. A real time flowrate of the well is estimated based on the real time flow velocity of the production fluid and volume of tubing between the spaced apart locations. Alternatively included with the method is adjusting an amount of the lift fluid being added to the stream based on the step of estimating the real time flowrate. The amount of the lift fluid being added to the stream is optionally adjusted so that an amount of production fluid being produced by the well is approximately the same as a designated amount of production fluid. In an example, the addition of lift fluid into the tubing is suspended for a designated period of time to introduce the marker fluid into the tubing. The marker fluid is one example a slug of production fluid in the tubing. A slip coefficient is optionally estimated based on a ratio of the flow velocity from the well test and the reference flow velocity of the production fluid; in an alternative, the slip coefficient is used to adjust the real time flow velocity of the production fluid.

Another method of operating a well is disclosed and which involves obtaining flow data of the well measured during a well test performed at a point in time, obtaining reference flow data of the well based on monitoring a marker fluid flowing in the well under conditions in the well that were similar to conditions in the well occurring during the point in time, obtaining real time flow data of the well based on monitoring marker fluid flowing in the well after the point in time, and controlling a flow of production fluid from the well based on the real time flow data. In an embodiment, the method further includes adding gas lift fluid to the well. Adjusting an amount of the gas lift fluid added to the tubing is one way to control a flow of production fluid. In an alternative, the amount of gas lift fluid being added to the stream is adjusted based on a ratio of the well test flow data and the reference flow data. Optionally, the marker fluid includes production fluid from a formation adjacent the well. In an embodiment, flow data of the well after the point in time is estimated by, suspending gas lift addition for a period of time to introduce a slug of production fluid into production tubing disposed in the well, tracking the progression of the slug through the production tubing by monitoring pressure at locations in the production tubing that are spaced an axial distance apart, and estimating a flow velocity of the slug based on a travel time of the slug between the locations and the axial distance. A flowrate of production fluid in the tubing in one example is estimated based on the flow velocity of the slug, and a volume in the tubing between the locations. A density of a column of the production fluid between the locations is optionally estimated based on a difference in pressure monitored at the locations, and wherein an estimate of constituents in the production fluid is estimated based on the density. In one example, the flow data of the well measured during a well test performed at a point in time includes a flowrate of fluid flowing through the well, an identification of the constituents making up the fluid flowing through the well, and fluid properties of the constituents.

BRIEF DESCRIPTION OF DRAWINGS

Some of the features and benefits of the present invention having been stated, others will become apparent as the description proceeds when taken in conjunction with the accompanying drawings, in which.

Figure 2:
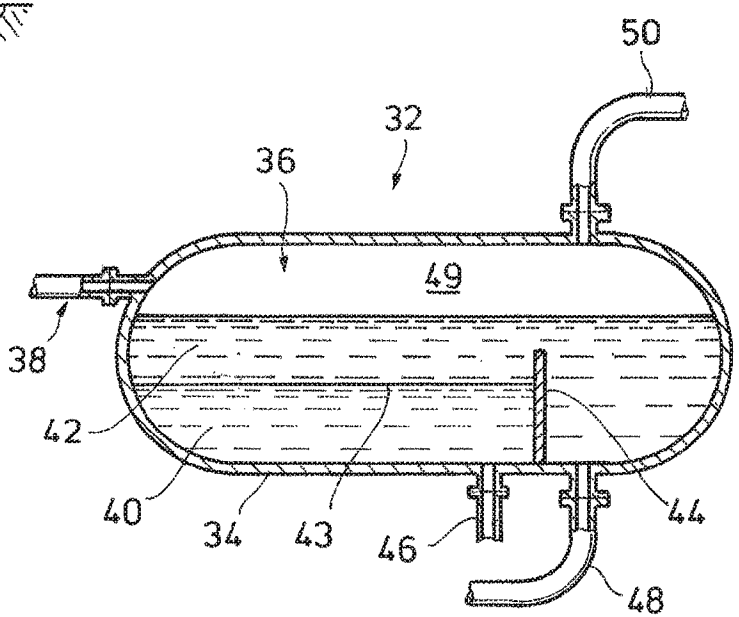
FIG. 2 is a side partial sectional view of an example of a separation tank used in a well test.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
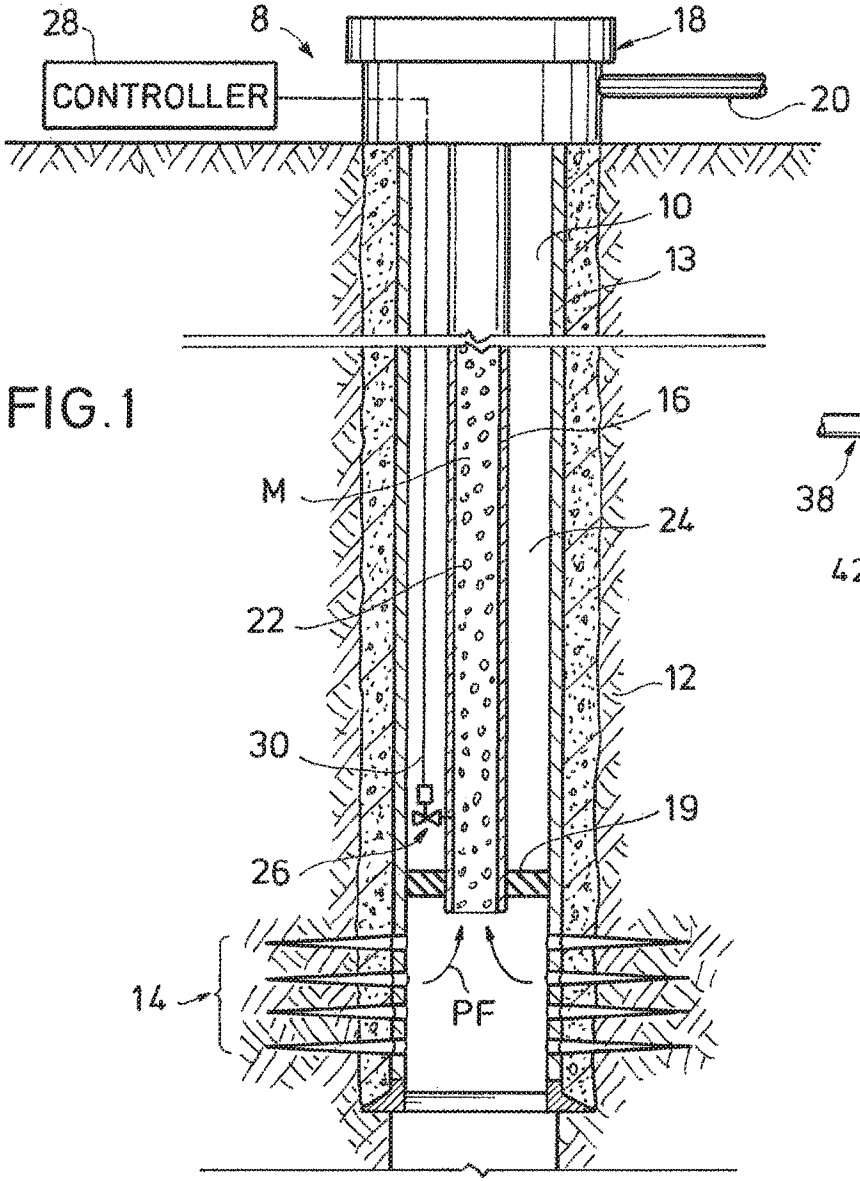
FIG. 1 is a side partial sectional view of an example of a hydrocarbon producing well with gas lift being injected into production tubing in the well.

Shown in a partial side sectional view in FIG. 1 is an example of a well 8 for producing hydrocarbons, and which includes a wellbore 10 formed into a subterranean formation 12 that surrounds the wellbore 10. In this example, casing 13 lines a portion of the wellbore 10, and defines a barrier to fluid flowing from the formation 12 into the wellbore 10. Perforations 14 are shown penetrating the casing 13 and extending into the formation 12 and projecting radially outward from an outer sidewall of wellbore 10. A produced fluid PF, schematically depicted by arrows in this example, is shown entering wellbore 10 through casing 13 via the perforations 14. Produced fluid PF resides in formation 12, and in an example is made up of one or more of liquid hydrocarbon, water, and produced gas. Coaxially inserted within well 10 is a string of production tubing 16 for directing produced fluid PF entering tubing 16 to a wellhead assembly 18 on surface. Further in the example of FIG. 1, a production line 20 is shown attached to a side of wellhead assembly 18.

The example wellbore 10 in FIG. 1 is illustrated as being a gas lift well with injection gas 22 being introduced into the tubing 16 to reduce the density of production fluid PF for increasing a flow of production fluid PF. Inside the tubing 16, the injection gas 22 and production fluid PF combine to form a mixture M which is directed to wellhead assembly 18. In this example, injection gas 22 is introduced into tubing 16 from an annulus 24 circumscribing tubing 16; where annulus 24 is formed between tubing 16 and casing 13. Further illustrated is a packer 19 disposed in the annulus 24 proximate the entrance of the tubing 16 that blocks communication between perforations 14 and annulus 24, and which diverts the production fluid PF into the tubing 16. Examples exist where injection gas 22 is introduced into annulus 24 from surface; optionally, all or a part of injection gas 22 is gas extracted from the production fluid from formation 12 or a different formation (not shown). A valve assembly 26 is schematically illustrated mounted on an outer surface of tubing 16 and within annulus 24. In an embodiment, valve assembly 26 includes a valve, and an actuator (not shown) for opening and closing valve. Alternatives exist where valve assembly 26 selectively provides communication into tubing 16 from annulus 24 through other means, such as in response to an applied pressure or temperature. Further illustrated is an optional controller 28 in communication with valve assembly 26 via a line 30. In a non-limiting example, operation of valve assembly 26 is based on commands from controller 28 to valve assembly 26 with line 30. Communication between controller 28 and valve assembly 26 is not limited to the schematically illustrated hardwire embodiment of line 30, but includes wireless means, and any now known or later developed forms of communication.

In FIG. 2 an example of an optional test tank 32 is shown in a side partial sectional view. In an example, test tank 32 is selectively used as part of a procedure commonly referred to as a well test. In an embodiment, mixture M (FIG. 1) and or production fluid PF is analyzed. Example results of the well test include one or more of a flow rate of the mixture M, a flow rate of the production fluid PF, constituents making up mixture M, and their respective percentages, as well as constituents making up production fluid PF, and their respective percentages. In the illustrated example, tank 32 includes an outer housing 34; and an open space inside housing 34 defines an inner chamber 36. An inlet line 38 is shown intersecting housing 34 and which in an example is in fluid communication with production line 20 of FIG. 1. As noted above, mixture M includes a combination of produced fluid PF and injection gas 22.

One example function of tank 32 is the separation of constituents making up mixture M. Depicted in FIG. 2 is that liquid constituents have substantially stratified, and water 40 from the produced fluid PF has settled in a bottom portion of chamber 36. Produced fluid PF in this example includes an amount of liquid hydrocarbon 42, and which typically has a density less than water 40; and depicted residing above an upper surface of water 40. An interface 43 is formed between the stratified layers of water 40 and liquid hydrocarbon 42 Also shown in the example chamber 36 is a weir 44 projecting axially upward from a lower inner surface of housing 34, and which defines a wall spanning between opposing sidewalls of housing 34. The height of weir 44 is greater than that of interface 43; which retains water 40 between weir 44 and the end of tank 32 where inlet line 38 attaches. Below interface 43, water 40 and liquid hydrocarbon 42 are separated by weir 44. A water line 46 is shown intersecting a lower surface of housing 34 and on the side of weir 44 having water 40. Water 40 is selectively drained from tank 32 through water line 46. Similarly, an oil line 48 attaches to a lower surface of housing 34 and on a side of weir 44 opposite water 40; liquid hydrocarbon 42 is selectively drained from tank 32 via oil line 48.

Still referring to FIG. 2, gas 49 is shown collected within an upper head space of cavity 36. In an embodiment, gas 49 is made up of, gas from the production fluid PF, injection gas 22 (FIG. 1), or a combination. A gas line 50 attaches to an upper surface of housing 34 and which carries gas 49 away from separator 32. In one example operation of a well test, fluid (such as the mixture M) flowing within production line 20 is directed into tank 32. The time period is recorded over which the mixture M flows into the tank 32. Further in this example, measurements are taken of constituents making up the mixture M, such as amounts (volume and or mass) of the water 40, liquid hydrocarbon 42, and gas 49 within separator 32. In a non-limiting example, a flowrate of the mixture M is estimated based on the recorded time period, and measured amounts of the constituents. Further optionally, a flowrate of the produced fluid PF is estimated by accounting for the amount of injected gas 22 added to the mixture M. In an example, well test is conducted when a flowrate of production fluid PF remains within a range of values deemed by those skilled to be stable. In an alternative, a flowrate, and or velocity of flow of mixture M and/or production fluid PF estimated by a well test are designated as baseline flowrates or velocities.

In one non-limiting example of operating well 8 of FIG. 1, flow from the well 8 is estimating by monitoring a marker fluid that is conveyed within tubing 16. In an alternative, a marker fluid is a substance or device that is transportable in the tubing 16 in response to a flow of fluid, and that is trackable inside the tubing 16. Examples of marker fluid include an amount of a fluid, such as a liquid or gas, with properties (such as density) that are different from mixture M (and/or production fluid PF) flowing in tubing 16. Embodiments of fluids having properties different from mixture M (and/or production fluid PF) are distinguishable within tubing 16 using sensors, and whose location inside tubing 16 is identifiable. Additional examples of marker fluid include dyes, radioactive substances, and signal emitting devices. Further in this example, a speed by which marker fluid travels through tubing 16 is monitored under conditions in the well 8 that are the same or substantially similar to conditions existing when conducting a well test; such as the example well test discussed above in conjunction with FIG. 2. In an alternative, marker fluid speed is monitored concurrent with conducting well test. In one embodiment, the flow velocity of the mixture M (and/or production fluid PF) monitored during the well test is referred to as a reference or baseline flow velocity of the mixture M (and/or production fluid PF). Similarly in this embodiment, the flow velocity of the marker fluid monitored at conditions concurrent with, the same as, or substantially similar to the well test, is referred to as a reference flow velocity of the marker fluid. A correction or slip coefficient is optionally derived from a ratio of reference flow velocities of mixture M (and/or production fluid PF) and the marker fluid. Not to be bound by theory, but it is believed that the slip coefficient accounts for interactions between the marker fluid and mixture M (and/or production fluid PF) while the fluids progress through the tubing 16. Alternatives exist where injection gas 22 is being introduced into the tubing 16 at the same time the well test is being conducted, and also when marker fluid is being added to production fluid PF. In an example of obtaining a real time flow velocity of the mixture M (and/or production fluid PF), marker fluid is introduced into the wellbore 10, the marker fluid position over time flowing in the wellbore 10 is tracked to obtain a real time flow velocity of the marker fluid, and a flow velocity of the mixture M (and/or production fluid PF) is estimated based on the real time flow velocity of the marker fluid and the slip coefficient.

An advantage of the disclosed technique of estimating a real time flow velocity of the mixture M (and/or production fluid PF) is that production from the well 8 is estimated without interrupting production, which is not possible with a traditional well test. For the purposes of discussion herein, production from the well 8 includes a flowrate of the mixture M (and/or production fluid PF) in the tubing 16 and/or through production line 20. Example reasons for estimating fluid makeup or flowrates include assessing production from the formation 12 and how changes to a flow or type of injection gas 22 flowing into the tubing 16 affects fluid flowrate in the tubing 16. Optionally, the valve assembly 26 and sensors 54, 58 are automated, or are controlled remotely; which provides another advantage over that of a traditional well test as there is no need for personnel to be onsite at the well 8. Moreover, the procedure described within is optionally performed daily, weekly, monthly, semi-monthly, and any other desired frequency. With up to date knowledge of a real time flow velocity of the mixture M (and/or production fluid PF), options exist to vary operation of the well 8 to adjust a flowrate of the mixture M (and/or production fluid PF) with greater frequency than using traditional techniques. Examples of varying operation of the well 8 include one or more of changing the rate of injection gas 22 being introduced into the tubing 16 by increasing the flow capacity of valve 26 or increasing pressure in the annulus 10, varying a pressure drop in the production line, and other known or later developed well control steps.

Figure 3B:
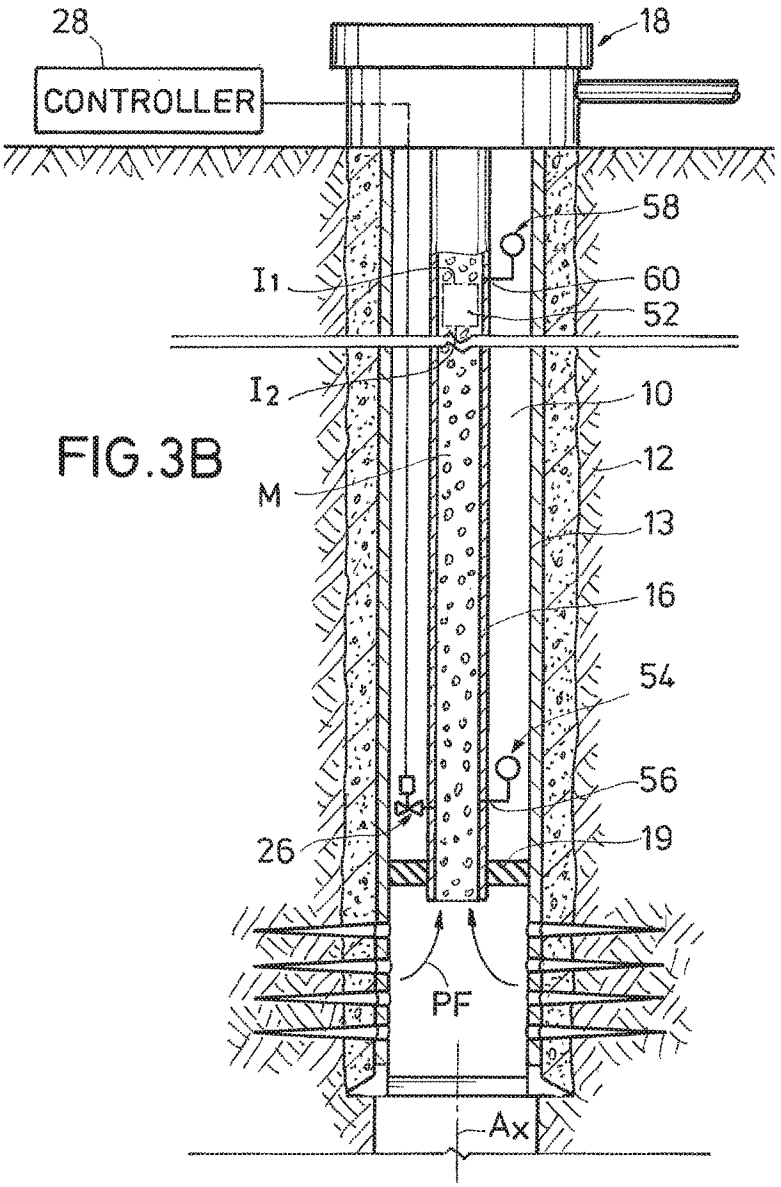
FIG. 3B is a side partial sectional view of the example well of FIG. 3A, and where the slug of produced fluid is at a lower depth in the production tubing.
Figure 3A:
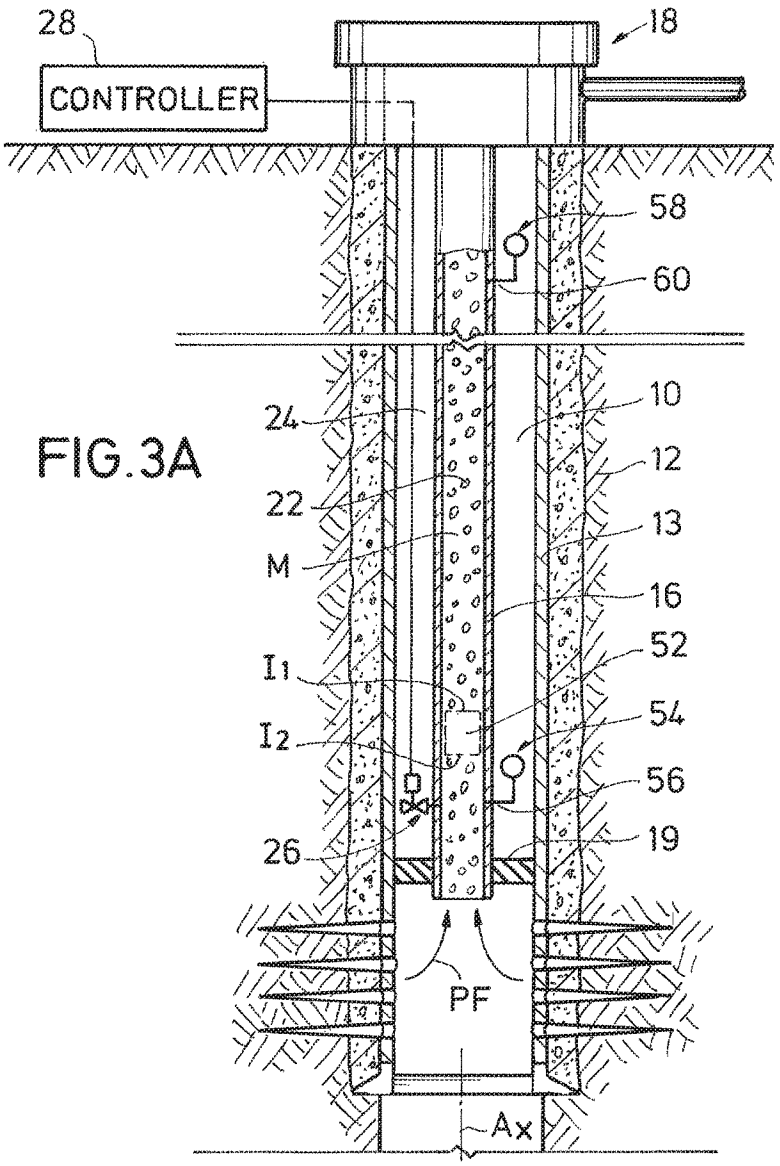
FIG. 3A is a side partial sectional view of the example well of FIG. 1, and where a slug of produced fluid is selectively introduced into the production tubing.

Referring now to FIG. 3A, shown in a side partial sectional view is one example of conducting a real time flow rate estimation using a marker fluid. In this example, valve assembly 26 is actuated to a closed position thereby blocking flow of any injection gas 22 within annulus 24 and into tubing 16. Further in this example, the valve assembly 26 is closed for a designated period of time temporarily suspending the flow of injection gas 22 into tubing 16; and which allows a slug 52 of production fluid PF to enter into production tubing 16. In the examples of FIGS. 3A and 3B, slug 52 operates as a marker fluid. In the illustrated example, the slug 52 remains a fairly cohesive amount of production fluid PF, which is distinct and discernible from the mixture M in the remaining portions of tubing 16. As noted above, mixture M includes production fluid PF and injection gas 22; with fluid properties, such as viscosity and density, that differ from the slug 52 of production fluid PF alone. In one non-limiting example of operation, valve assembly 26 is held in the closed configuration for a period of time to form the slug 52 of adequate proportions to be sensed by known techniques. Optionally, such proportions of slug 52 are that it occupies the entire cross sectional area inside tubing 16, and having a length (extending longitudinally along an axis Ax of tubing 16) so that interfaces $I_1$, $I_2$ between opposing axial ends of the slug 52 and the mixture M are detectable. In the example of FIG. 3A, valve assembly 26 remains closed until slug 52 is of a designated dimension; and then valve assembly 26 is returned to the open configuration to flow injection gas 22 into tubing 16 and below slug 52.

As shown in FIG. 3B, slug 52 is urged upward within tubing 16 and towards wellhead assembly 18. Illustrated in the example of FIG. 3B is that slug 52 is detectable as it travels up tubing 16, and interfaces I1, 12 remain between slug 52 and mixture M. Examples exist where density of slug 52 is greater than the mixture M, but rises within tubing 16 because mixture M flowing upward in tubing 16 provides a sufficient lift force to raise slug 52. Further noted in FIG. 3B is that the valve assembly 26 remains in the open position to reform mixture M below slug 52. Further provided in the example of FIGS. 3A and 3B is a sensor 54 shown in annulus 24, and a tap 56 formed radially through a sidewall of tubing 16 that provides communication between sensor 54 and the inside of tubing 16. In the example shown, tap 56 is illustrated at a location proximate to valve assembly 26. An additional sensor 58 is provided in this example shown at a location within well 10 and above sensor 54. Similarly, tap 60 penetrates tubing 16 and provides communication between sensor 58 and inside of tubing 16. Examples exist where sensor 58 is below surface inside annulus 24 and proximate wellhead assembly 18. In an example, sensors 54, 58 sense various conditions within tubing 16, such as pressure, temperature, and fluid viscosity. In an embodiment, a fluid static head measured by sensors 54, 58 in real time is compared to a fluid static head measured by sensors 54, 58 concurrent with or under conditions the same as the well test; and a real time fluid make-up in the tubing 16 is estimated based on differences in the fluid static head measurements. Further in this embodiment, fluid density in tubing 16 is estimated based on the fluid static head and distances between taps 56, 60. With knowledge of the fluid make up from the well test, a current fluid make up is extrapolated from the reference or baseline fluid make up depending on the difference between the fluid static head measurements. In an example, after subtracting the quantity of injected gas a difference between the fluid make-up of the current sample and the reference sample from the well test is detected that is outside pre-determined bounds, then an error notification is provided to operations personnel. Examples of actions performed after receiving the error notification include, accepting the sensed values and continuing, manually entering a new composition, rerun the system from scratch to start again.

Figure 4:
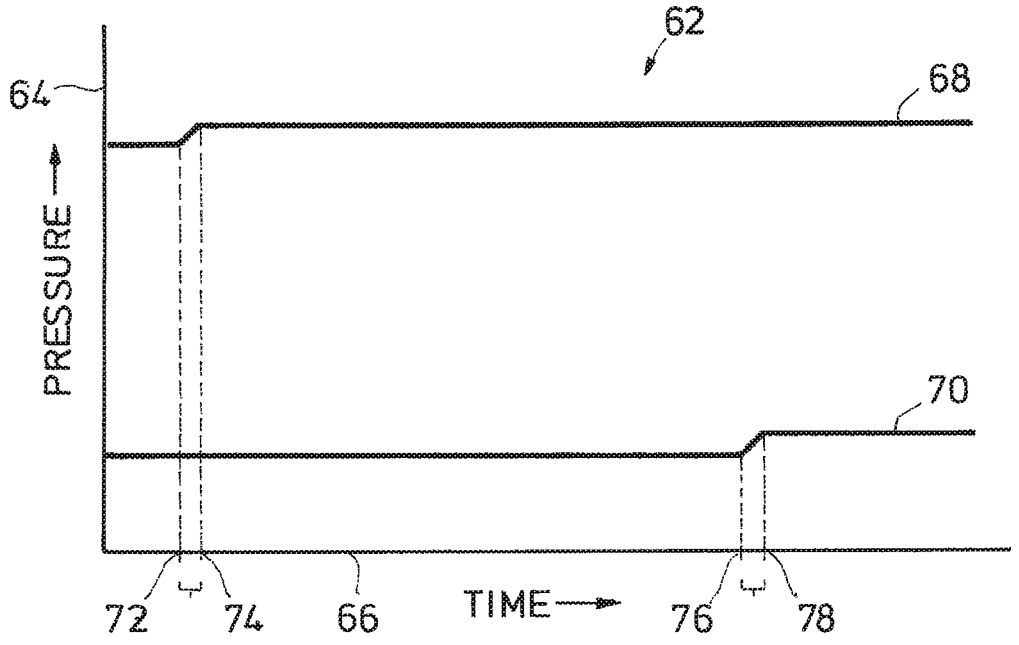
FIG. 4 is a graphical representation of an example of pressure in the production tubing of FIGS. 3A and 3B over a period of time.

Illustrated in FIG. 4 is a plot 62 having an ordinate 64 and an abscissa 66; where pressure values are represented on ordinate, and time values are represented along abscissa 66. Also in plot 62 are lines 68, 70 that each depict example values of pressures measured over a span of time respectively at taps 56, 58 of FIGS. 3A and 3B. A portion of line 68 between points of time 72, 74 has a positive slope indicating a linear increase in pressure, and identifying a span of time during which the slug 52 is adjacent tap 56. The increase in pressure over time between points of time 72, 74 of this example is due to the slug 52 (i.e. production fluid PF) having a density greater than mixture M. Similarly, line 70 reflects an increase in pressure between points in time 76, 78. In an example, an estimate of the velocity of slug 52 traveling within tubing 16 between taps 56, 60 is obtained by dividing a distance between taps 56 and 60 by the time span of points 74 and 78. Alternatives exist where one or both the reference flow speed and real time flow speed of slug 52 is estimated using the techniques above described and illustrated in FIGS. 3A, 3B, and 4.

EXAMPLE

In a non-limiting example of operation, a well test of well 8 is conducted while injection gas 22 is being added to the tubing 16. A baseline or reference flow velocity $V_{MR}$ of mixture M in tubing 16 is estimated from the well test. Concurrent with the well test, or under conditions in the well that are the same or substantially similar to when the well test is conducted, slug 52 is formed in tubing 16 as described above, and a reference flow velocity $V_{SR}$ of slug 52 is estimated based on a time period between when slug 52 is sensed by sensors 54, 58 to be adjacent to taps 56, 60, and a distance between taps 56, 60. A slip coefficient $S_C$ for the slug 52 is derived from the following relationship: $S_C$= (reference flow velocity $V_{MR}$)/(a reference flow velocity $V_{SR}$ of slug 52). At a point in time after the well test is conducted, and when flow from well 8 is stabilized, a real time slug 52 is formed in tubing 16 and a real time flow velocity $V_{RealTime}$ of slug 52 is measured based on a time period between when real time slug 52 is sensed by sensors 54, 58 to be adjacent to taps 56, 60, and the distance between taps 56, 60. The measured value of the real time flow velocity $V_{RealTimeSlug}$ of the slug 52 is multiplied by the slip coefficient $S_C$ to obtain an estimated real time flow velocity $V_{RealTimeM}$ of the mixture M. An error notification is generated and directed to operations personnel if a difference is detected between the real time flow velocity $V_{RealTimeM}$ of the mixture M and a designated flow velocity of the mixture M exceeds a threshold amount. An optional subsequent action is to adjust control of the well 8 so that the difference falls below the threshold.

Figure 5:
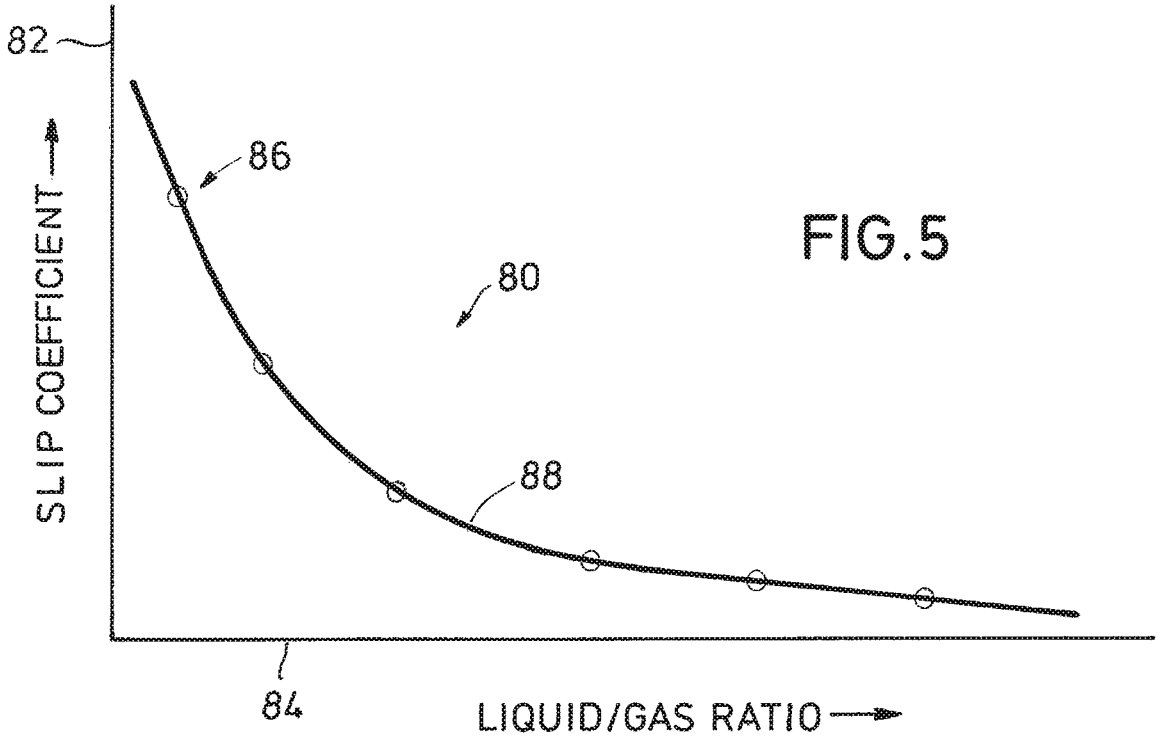
FIG. 5 is a graphical representation of prophetic values of slip coefficients and corresponding values of liquid to gas ratios.

In an embodiment, values of slip coefficients are obtained for different instances where the liquid to gas ratio values of the mixture M (and/or production fluid PF) vary. Illustrated in graphical form in FIG. 5 is a prophetic example of the respective values of the slip coefficients and corresponding liquid to gas ratios. Depicted in FIG. 5 is a plot 80 having an ordinate 82 and an abscissa 84; where slip coefficient values are represented on ordinate 82, and values of liquid/gas ratios are represented along abscissa 84. Data points 86 represent prophetic example values of the recorded slip coefficient and ratios, line 88 is curve fit to the data points 86. In an alternative, consulting data provided in plot 80, or by extrapolating from line 88, a slip coefficient value is estimated based on a known or estimated liquid to gas ratio.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of operating a well comprising:

obtaining data from a well test that comprises a flow velocity of production fluid flowing in tubing disposed in the well;

adding a lift fluid to the tubing;

monitoring pressure in the tubing over time and at spaced apart locations;

introducing a detectable marker fluid into the tubing at a time when conditions in the well are substantially similar to conditions in the well during the well test, detecting the presence of the marker fluid at the spaced apart locations based on the step of monitoring pressure in the tubing, estimating a reference flow velocity of the production fluid based on a distance between the spaced apart locations and a time span between when the presence of the marker fluid is detected at the spaced apart locations;

introducing into the tubing an amount of marker fluid having a density different from a density of a mixture of the production fluid and lift fluid and at a point in time after the well test was performed, detecting the presence of the marker fluid at the spaced apart locations based on the step of monitoring pressure in the tubing, and estimating a real time flow velocity of the production fluid based on a distance between the spaced apart locations and a time span between when the presence of the marker fluid is detected at the spaced apart locations;

estimating a real time flowrate of the well based on the real time flow velocity of the production fluid and volume of tubing between the spaced apart locations; and estimating a slip coefficient based on a ratio of the flow velocity from the well test and the reference flow velocity of the production fluid, and using the slip coefficient to adjust the real time flow velocity of the production fluid.

2. The method of claim 1, further comprising adjusting an amount of the lift fluid being added to the stream based on the step of estimating the real time flowrate.

3. The method of claim 2, wherein the amount of the lift fluid being added to the stream is adjusted so that an amount of production fluid being produced by the well is approximately the same as a designated amount of production fluid.

4. The method of claim 1, wherein the step of introducing the marker fluid into the tubing comprises suspending the addition of lift fluid into the tubing for a designated period of time.

5. The method of claim 1, wherein the marker fluid comprises a slug of production fluid in the tubing.

6. A method of operating a well comprising:

obtaining flow data of the well measured during a well test performed at a point in time;

providing a marker fluid in the well that comprises a cohesive slug of production fluid;

obtaining reference flow data of the well based on monitoring the marker fluid flowing in the well under conditions in the well that were similar to conditions in the well occurring during the point in time;

obtaining real time flow data of the well based on monitoring marker fluid flowing in the well after the point in time;

estimating a slip coefficient based on a ratio of the flow velocity from the well test and the reference flow velocity of the production fluid, and using the slip coefficient to adjust the real time flow velocity of the production fluid; and controlling a flow of production fluid from the well based on the adjusted real time flow data.

7. The method of claim 6, further comprising adding gas lift fluid to the well.

8. The method of claim 7, wherein the step of controlling a flow of production fluid comprises adjusting an amount of the gas lift fluid added.

9. The method of claim 8, wherein the amount of gas lift fluid being added to the stream is adjusted based on a ratio of the well test flow data and the reference flow data.

10. The method of claim 7, wherein the production fluid is from a formation adjacent the well.

11. The method of claim 10, wherein flow data of the well after the point in time is estimated by, introducing the slug of production fluid into production tubing disposed in the well, tracking the progression of the slug through the production tubing by monitoring pressure at locations in the production tubing that are spaced an axial distance apart, and estimating a flow velocity of the slug based on a travel time of the slug between the locations and the axial distance.

12. The method of claim 11, further comprising suspending gas lift addition for a period of time to introduce the slug of production fluid into the production tubing.

13. The method of claim 11, further comprising reducing gas lift addition for a period of time to introduce the slug of production fluid into the production tubing.

14. The method of claim 11, wherein a flowrate of production fluid in the tubing is estimated based on the flow velocity of the slug, and a volume in the tubing between the locations.

15. The method of claim 14, wherein a density of a column of the production fluid between the locations is estimated based on a difference in pressure monitored at the locations, and wherein an estimate of constituents in the production fluid is estimated based on the density.

16. The method of claim 6, wherein the flow data of the well measured during a well test performed at a point in time comprises a flowrate of fluid flowing through the well, an identification of the constituents making up the fluid flowing through the well, and fluid properties of the constituents.

17. A method of operating a well comprising:

obtaining data from a well test that comprises a flow velocity of production fluid flowing in tubing disposed in the well;

adding a lift fluid to the tubing;

monitoring pressure in the tubing over time and at spaced apart locations;

introducing a detectable marker fluid into the tubing at a time when conditions of the fluid flowing in the tubing are similar to conditions of the fluid flowing in the tubing during the well test, detecting the presence of the marker fluid at the spaced apart locations based on the step of monitoring pressure in the tubing, estimating a reference flow velocity of the production fluid based on a distance between the spaced apart locations and a time span between when the presence of the marker fluid is detected at the spaced apart locations;

introducing into the tubing an amount of marker fluid having a density different from a density of a mixture of the production fluid and lift fluid and at a point in time after the well test was performed, detecting the presence of the marker fluid at the spaced apart locations based on the step of monitoring pressure in the tubing, and estimating a real time flow velocity of the production fluid based on a distance between the spaced apart locations and a time span between when the presence of the marker fluid is detected at the spaced apart locations;

estimating a real time flowrate of the well based on the real time flow velocity of the production fluid and volume of tubing between the spaced apart locations; and estimating a slip coefficient based on a ratio of the flow velocity from the well test and the reference flow velocity of the production fluid, and using the slip coefficient to adjust the real time flow velocity of the production fluid.

18. The method of claim 17, wherein the conditions are selected from the group consisting of temperature, pressure, fluid viscosity, and combinations.

19. The method of claim 17, further comprising adjusting the real time flowrate based on a comparison of the well test and the reference flow velocity.

* * * * *